US012454392B2

(12) United States Patent
Dubach

(10) Patent No.: US 12,454,392 B2
(45) Date of Patent: Oct. 28, 2025

(54) SCREW CLOSURE HAVING CAPTIVELY CONNECTED SCREW CAP

(71) Applicant: Deltona Innovations AG, Maur (CH)

(72) Inventor: Werner Dubach, Maur (CH)

(73) Assignee: Deltona Innovations AG (CH)

( * ) Notice: Subject to any disclaimer, the term of this patent is extended or adjusted under 35 U.S.C. 154(b) by 6 days.

(21) Appl. No.: 18/268,336

(22) PCT Filed: Dec. 15, 2021

(86) PCT No.: PCT/EP2021/085915
§ 371 (c)(1),
(2) Date: Jun. 20, 2023

(87) PCT Pub. No.: WO2022/136054
PCT Pub. Date: Jun. 30, 2022

(65) Prior Publication Data

US 2024/0034519 A1 Feb. 1, 2024

(30) Foreign Application Priority Data

Dec. 21, 2020 (CH) ..... 1641/20

(51) Int. Cl.
*B65D 41/34* (2006.01)
*B65D 1/02* (2006.01)
*B65D 55/16* (2006.01)

(52) U.S. Cl.
CPC ..... *B65D 41/3447* (2013.01); *B65D 1/0246* (2013.01); *B65D 55/16* (2013.01); *B65D 2251/1008* (2013.01); *B65D 2401/30* (2020.05)

(58) Field of Classification Search
CPC .. B65D 41/3447; B65D 1/0246; B65D 55/16; B65D 2251/1008; B65D 2401/30
See application file for complete search history.

(56) References Cited

U.S. PATENT DOCUMENTS

2012/0285921 A1 11/2012 Kwon
2012/0298666 A1 11/2012 Kwon
2013/0001185 A1* 1/2013 Antier ..... B65D 55/16 215/253

FOREIGN PATENT DOCUMENTS

CN 105416813 A 3/2016
DE 102018128886 A1 7/2020
(Continued)

OTHER PUBLICATIONS

English translation of DE 102019132541. (Year: 2024).*
(Continued)

*Primary Examiner* — James N Smalley
(74) *Attorney, Agent, or Firm* — Lerner David LLP

(57) ABSTRACT

A captive screw closure with a tamper-evident band and a screw cap captively connected thereto is disclosed. The screw closure includes an outer surface with an internal thread and an upper surface. The mechanical strain on the retaining bands are substantially reduced. This is achieved by the screw closure having at least one pulling element which permits a pure axial longitudinal movement of the screw cap to the tamper-evident band in the direction of the longitudinal axis of the screw closure. The screw closure includes a pivoting element, in particular a pivoting plate, connected either fixedly or pivotably to the tamper-evident band. The pivoting element, in particular the pivoting plate, is detachably connected to the screw cap. The pivoting element, in particular the pivoting plate, may be connected to the screw cap in a fixed but pivotable manner.

20 Claims, 9 Drawing Sheets

(56) References Cited

FOREIGN PATENT DOCUMENTS

| | | | | | |
|---|---|---|---|---|---|
| DE | 102018130541 | A1 | | 7/2020 | |
| DE | 102019132541 | B3 | * | 11/2020 | ..... B65D 5/748 |
| EP | 2308772 | A1 | | 4/2011 | |
| JP | 2010083488 | A | | 4/2010 | |
| JP | 2011213372 | A | | 10/2011 | |
| WO | WO2019238988 | A1 | | 12/2019 | |
| WO | WO2020227813 | A1 | | 11/2020 | |
| WO | WO2020251984 1 | | | 12/2020 | |

OTHER PUBLICATIONS

JP2010083488A English Language Machine Translation.
JP2011213372A English Language Machine Translation.
CN105416813A English Language Machine Translation.
DE102018128886A1 English Language Machine Translation.
DE102018130541A1English Language Machine Translation.

* cited by examiner

SCREW CLOSURE HAVING CAPTIVELY CONNECTED SCREW CAP

CROSS REFERENCE TO RELATED APPLICATIONS

This application is a national phase application of International Application No. PCT/EP2021/085915, filed Dec. 15, 2021, which claims priority to Swiss Patent Applications CH01641/20, filed on Dec. 21, 2020, the content of all of the aforementioned of which is herein incorporated by reference.

BACKGROUND OF THE INVENTION

Field of the Invention

The present invention relates to a screw closure having a tamper-evident band and a screw cap captively connected thereto, the screw cap comprising an outer surface with an internal thread and an upper surface.

Description of Related Art

A captive bottle closure respectively screw closure is known from the document DE 10 2018 130 541 A1, wherein the screw closure comprises a tamper-evident band with a screw cap captively connected thereto by means of retaining straps respectively retaining elements.

The solution known from the document DE 10 2018 130 541 A1 with retaining straps respectively retaining elements has the disadvantage that the mechanical strain on the retaining straps respectively retaining elements is very high after repeated use of the screw closure and, due to the tilting movement of the screw cap when it is unscrewed, exerts a shearing force on the retaining straps which can lead to their destruction, resulting in an impermissible separation of the screw cap from the tamper-evident band and from the container.

BRIEF SUMMARY OF THE INVENTION

The present invention has set itself the task of providing a captive screw closure which overcomes the disadvantages of the prior art, while substantially reducing the mechanical strain on the retaining straps.

According to the invention, the screw closure has at least one pulling element which permits a pure axial longitudinal movement of the screw cap in the direction of the longitudinal axis of the screw closure to the tamper-evident band, and in that a pivoting element, in particular a pivoting plate, is either connected to the tamper-evident band in a fixed but pivotable manner, while the pivoting element, in particular the pivoting plate, is detachably connected to the screw cap, or the pivoting element, in particular the pivoting plate, is connected to the screw cap in a fixed but pivotable manner, while the pivoting element, in particular the pivoting plate, is detachably connected to the tamper-evident band, the pivoting plate permitting the deformation required for the pivoting movement.

In other words, in the sense of the present invention, the screw closure is first removed in a pure axial longitudinal movement, while the screw cap can subsequently be removed from a spout of the container to which the screw closure is attached by means of the pivoting plate in a pivoting movement. A stable end position is achieved in which the screw cap remains in the stable end position without external influence.

For the purposes of the present invention, a pure axial longitudinal movement of the screw cap in the direction of the longitudinal axis of the screw closure to the tamper-evident band by means of the at least one pulling element is understood to mean that during the axial longitudinal movement the pulling elements remain in close contact with the bottleneck with the advantage that as a result the pulling elements are subjected to very little mechanical strain.

It was advantageously found that the pulling elements remain in close contact with the bottleneck even during the pivoting movement and are thus subjected to only slight mechanical strain during the pivoting movement, since the pivoting movement is effected by means of the pivoting plate and the pulling elements are not subjected to any shear force.

In contrast to the retaining straps known from the document DE 10 2018 130 541 A1 for captive retaining of the screw cap after unscrewing, the screw closure according to the invention has a two-part design with at least one pulling element and a pivoting plate firmly formed thereon.

BRIEF DESCRIPTION OF THE SEVERAL VIEWS OF THE DRAWINGS

Further advantages features and details of the various embodiments of this disclosure will become apparent from the ensuing description of a preferred exemplary embodiment or embodiments and further with the aid of the drawings. The features and combinations of features recited below in the description, as well as the features and feature combination shown after that in the drawing description or in the drawings alone, may be used not only in the particular combination recited but also in other combinations on their own without departing from the scope of the disclosure.

The following is an advantageous embodiment of the invention with reference to the accompanying figures, wherein.

DETAILED DESCRIPTION OF THE INVENTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that "at least one of "A, B, and C" should be understood as including not only one of A, only one of B, only one of C, or any combination of A, B, and C.

Figure 1:
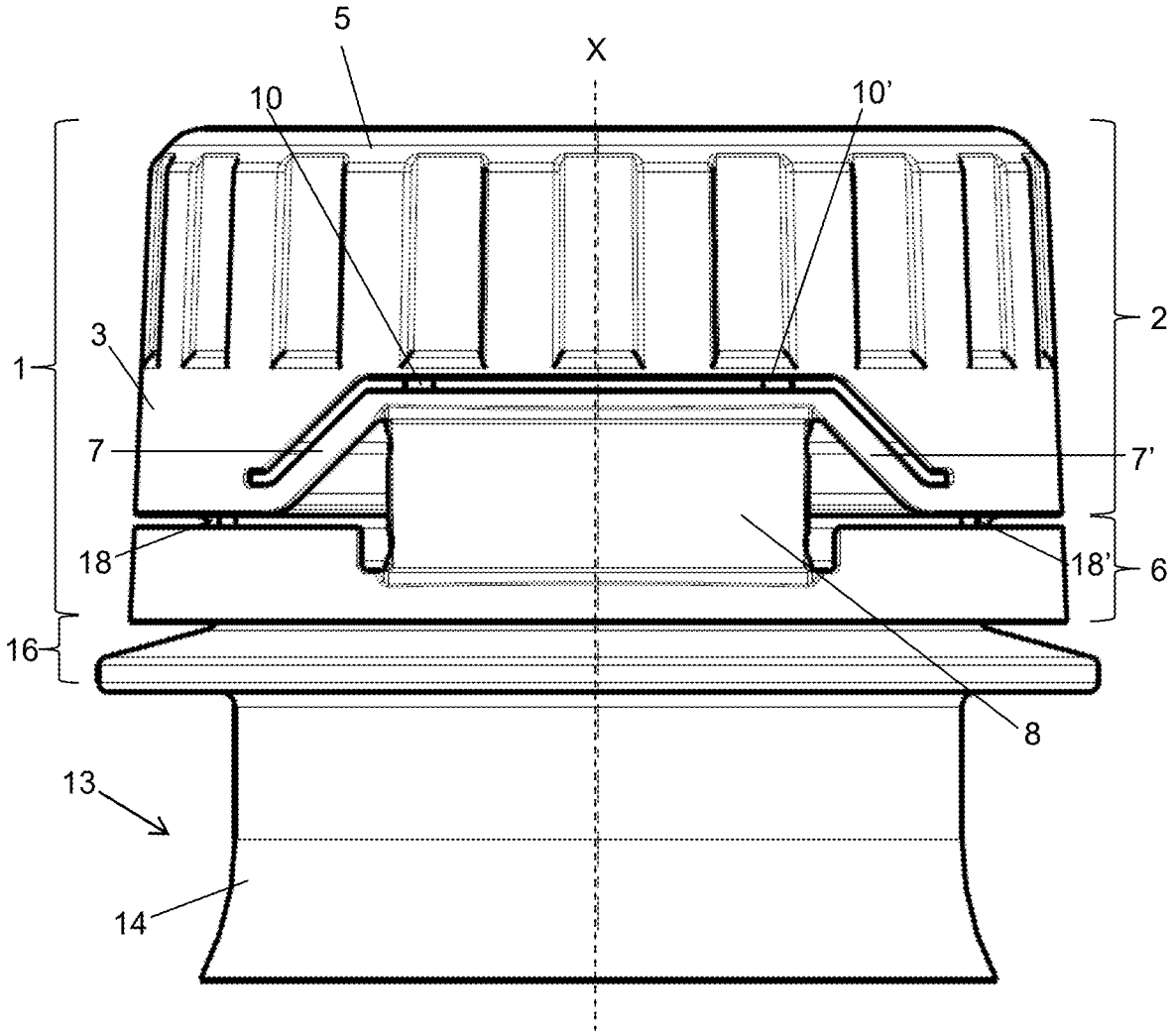
FIG. 1 depicts a perspective view of a first preferred embodiment of the screw closure according to the invention suitable for attachment to a plastic bottle in a closed position.

FIG. 1 shows a perspective view of a first preferred embodiment of the screw closure 1 according to the invention suitable for attachment to a plastic bottle 13 with a bottleneck 14 in a closed position. The screw closure 1 shown here is provided with a tamper-evident band 6 and a screw cap 2 captively connected thereto. The screw closure 1 comprises an outer surface 3 with internal thread 4 visible in FIG. 3 and an upper surface 5.

The screw closure 1 shown here has two pulling elements 7; 7' that permit a pure axial longitudinal movement of the screw cap 2 relative to the tamper-evident band 6 in the direction of the longitudinal axis X of the screw closure 1. As can be seen in FIG. 1, in the closed position or before the initial opening, the two pulling elements 7; 7' run upwards at an angle from the separation plane between the tamper-evident band 6 and the lower edge of the screw cap 2 and merge with the separation line between the screw cap 2 and the pivoting plate 8 and the upper edge of the pivoting plate.

In the preferred embodiment shown here, a pivoting plate 8 is also firmly but pivotably connected to the tamper-evident band 6, while the pivoting plate 8 is detachably connected to the screw cap 2 via predetermined breaking point bridges 10; 10' shown here, i.e. this detachable connection is broken when the screw cap 2 is turned. Further predetermined breaking point bridges 18; 18' effect here a detachable connection between the screw cap 2 and the tamper-evident band.

From here on and in the following, same reference signs denote the same components in the figures.

Figure 2:
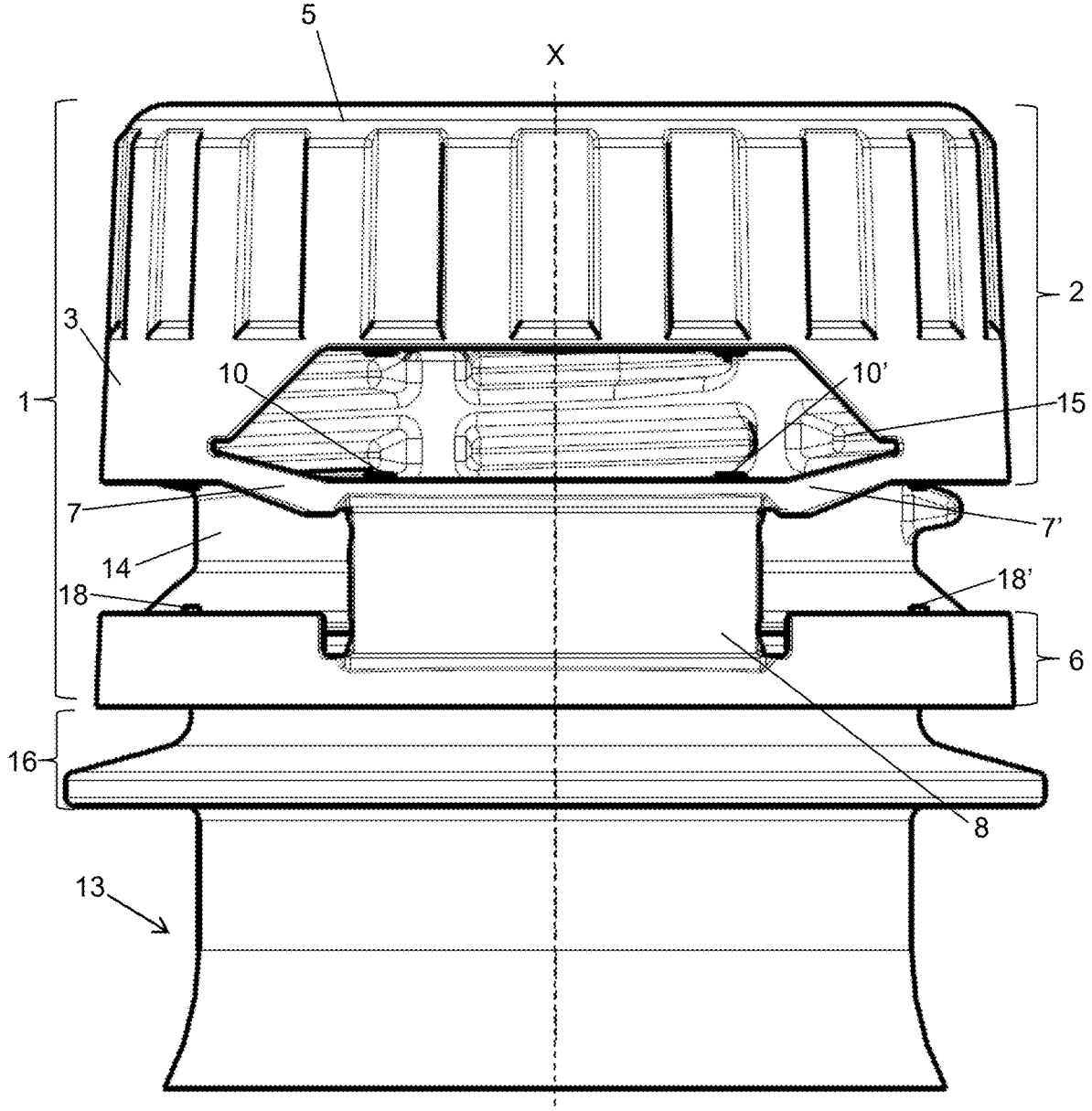
FIG. 2 depicts a perspective view of the first preferred embodiment of the screw closure according to the invention in an open position before pivoting the screw cap.

FIG. 2 shows a perspective view of the first preferred embodiment of the screw closure 1 according to the invention in an open position before pivoting the screw cap 2.

The detachable connections by means of the predetermined breaking point bridges 10; 10' between pivoting plate 8 and screw cap 2 respectively by means of the predetermined breaking point bridges 18; 18' between screw cap 2 and tamper-evident band 6 are separated here after rotation of the screw cap 2, so that the screw cap 2 can be pivoted in this position.

Figure 3:
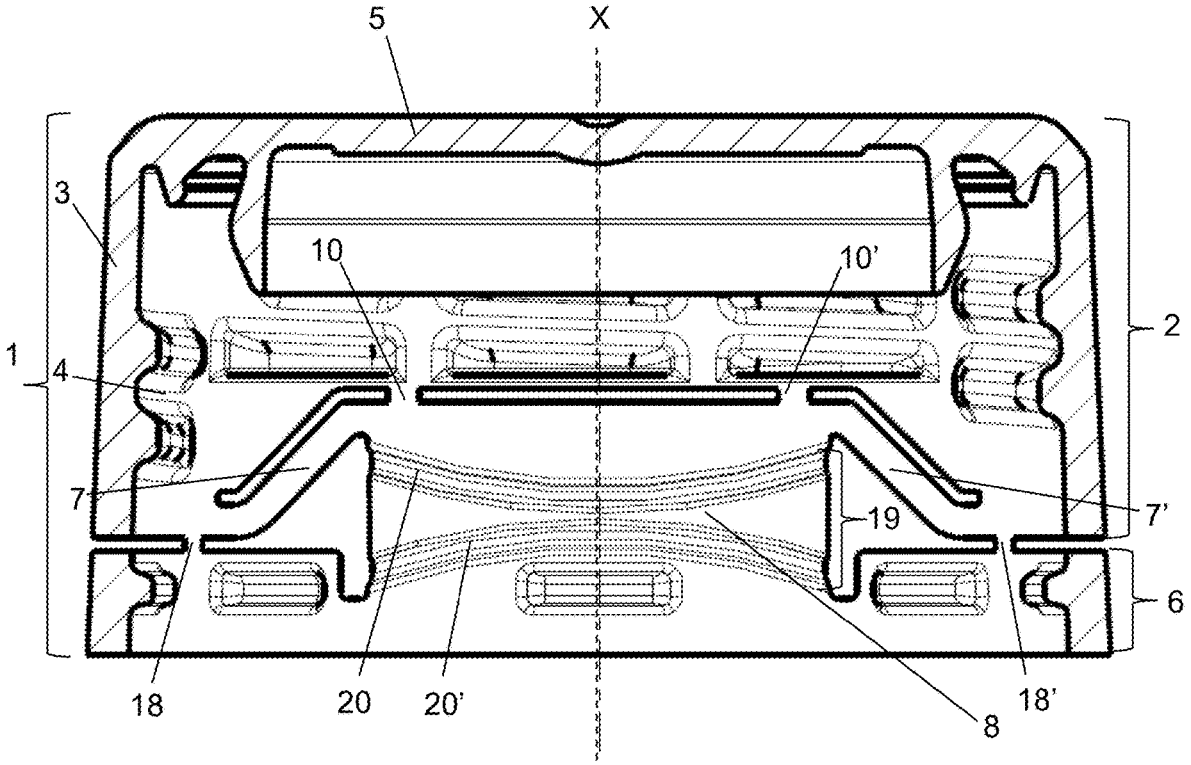
FIG. 3 depicts a sectional view through the first preferred embodiment of the screw closure according to the invention in a closed position.

FIG. 3 shows a sectional view through the first preferred embodiment of the screw closure according to the invention in a closed position.

As can be seen in FIG. 3, the pivoting plate 8 has an integrated pivoting hinge 19, the pivoting hinge 19 being formed from two arcuate and opposing film hinges 20; 20' connected across the entire width of the pivoting plate 8 which film hinges approach each other centrally in the direction of extent.

Figure 4:
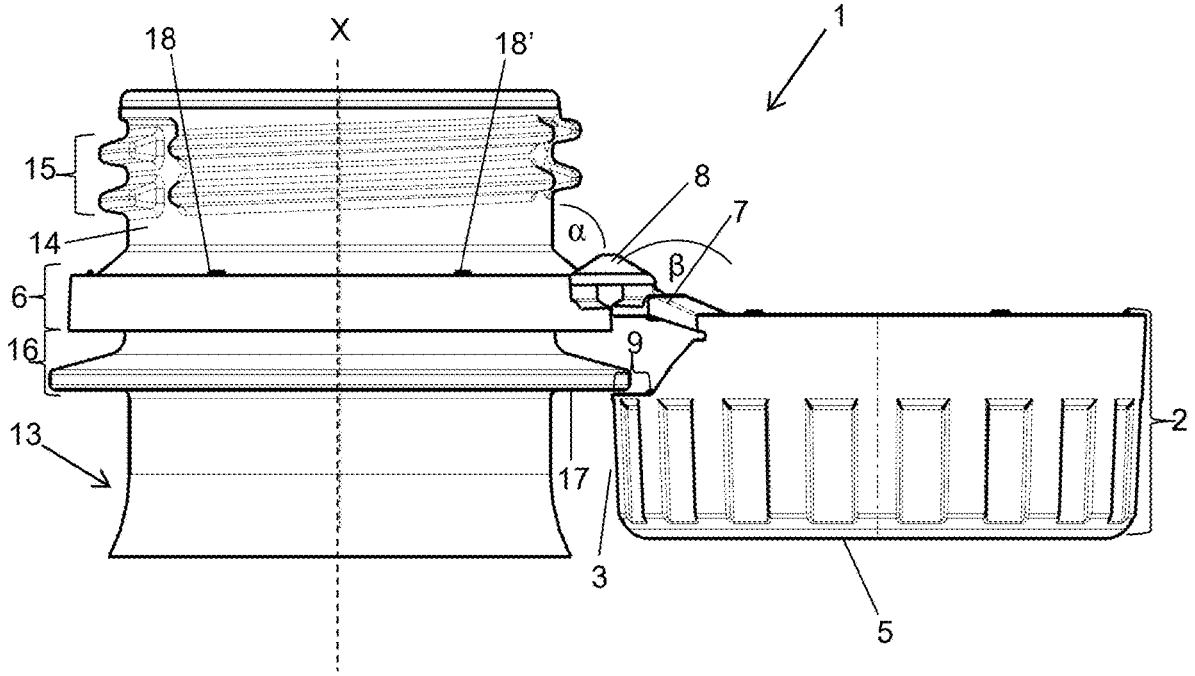
FIG. 4 depicts a perspective view of the first preferred embodiment of the screw closure according to the invention, wherein the screw cap is pivoted through an angle $\beta=180°$ and is in a secured end position.

FIG. 4 shows the first preferred embodiment of the screw closure 1 suitable for attachment to a plastic bottle 13. In the embodiment shown here, the pivoting plate 8 is firmly respectively non-detachably connected to the tamper-evident band.

The plastic bottle 13 shown here has a bottleneck 14 and an external thread 15, wherein a circumferential support ring 16 is arranged here below the external thread 15 and an annular retaining shoulder 17 extends below the circumferential support ring 16.

As can be seen in FIG. 4, the unscrewed screw cap 2 is pivoted here essentially by an angle β=180° with respect to the spout axis A respectively longitudinal axis X, while the pivoting plate 8 is pivoted essentially by an angle α=90° with respect to the spout axis A respectively longitudinal axis X, whereby the unscrewed screw cap 2 is in a secured end position. In this secured end position, the lower edge of the screw cap 2 is in direct contact with the retaining shoulder 17 of the support ring 16.

As can be seen in FIG. 4, in the secured end position the pivoting plate 8 lies essentially in the same plane as the support ring 16 on the bottleneck 13. In other words, here in the secured end position an edge section 9 of the screw cap 2 engages under the retaining shoulder 17 of the bottleneck 13.

Figure 5:
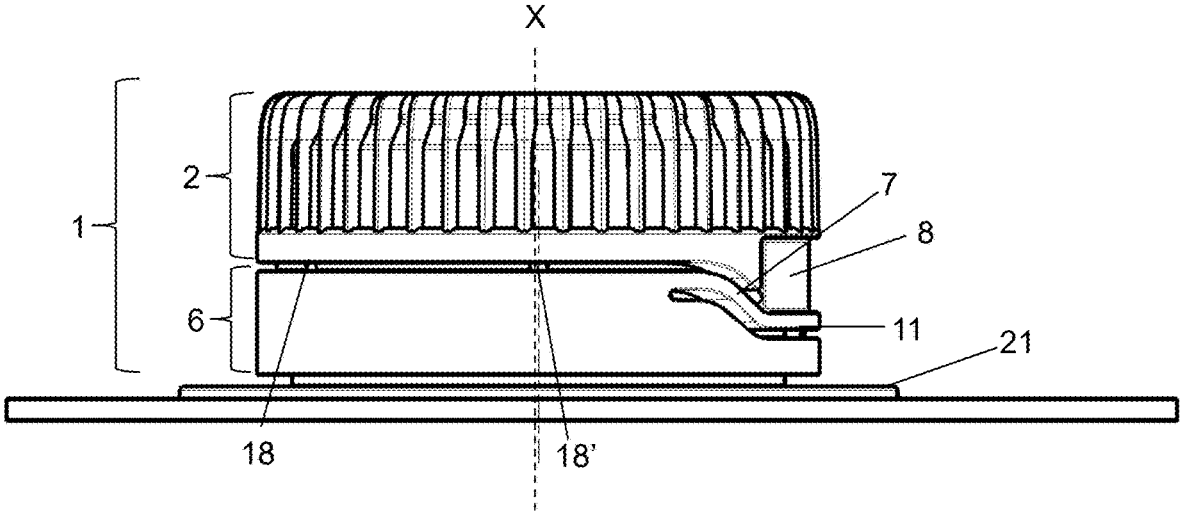
FIG. 5 depicts a perspective view of the second preferred embodiment of the screw closure according to the invention suitable for fastening on a cardboard container or a bag in a closed position.

FIG. 5 shows a perspective view of the second preferred embodiment of the screw closure 1 according to the invention suitable for attachment to a cardboard container or a flexible bag made of a plastic film or a cardboard laminated container having a spout 23 and a peripheral flange, in the closed position.

The screw cap 1 of the further preferred embodiment shown herein is for attachment to a spout 23 having a peripheral flange 21 for attachment to a cardboard container or bag.

The spout 23 here has at least one external thread 24 for fastening the screw cap 2. Furthermore, a circumferential retaining bead 22 is present here for axially securing the position of the tamper-evident band 6 on the spout 23.

In the preferred embodiment shown here, the pivoting plate 8 is firmly but pivotably connected to the screw cap 2 in the closed state before the initial opening, while the pivoting plate 8 is detachably connected to the tamper-evident band 6 via at least one predetermined breaking point bridge 11. The pivoting plate 8 is designed in such a way as to permit the deformation required for the pivoting movement. Furthermore, predetermined breaking point bridges 18; 18' are visible here between the screw cap 2 and the tamper-evident band 6.

Figure 6:
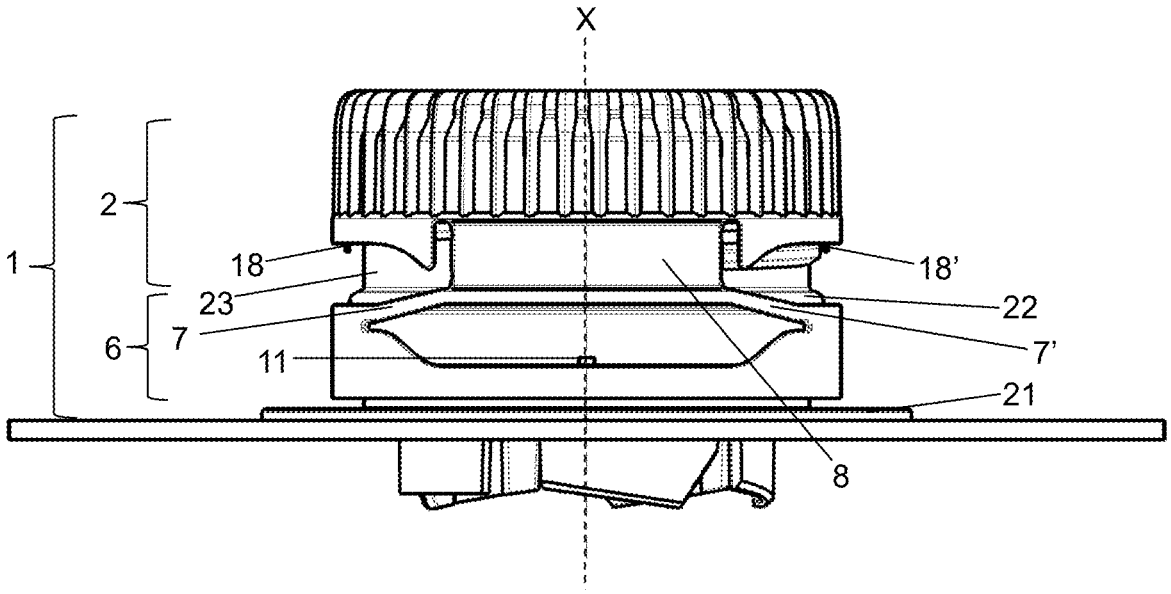
FIG. 6 depicts a perspective view of the second preferred embodiment of the screw closure according to the invention in an open position before pivoting the screw cap.

FIG. 6 shows a perspective view of the second preferred embodiment of the screw closure 1 according to the invention in an open position before the screw cap is pivoted.

The detachable connections are separated by means of the predetermined breaking point bridges 11; 11' respectively the predetermined breaking point bridges 18; 18'.

In the unscrewed state of the screw cap 2 shown here in FIG. 6, the screw cap can be pivoted to the spout axis X or to the pivoting plate 8.

Figure 7:
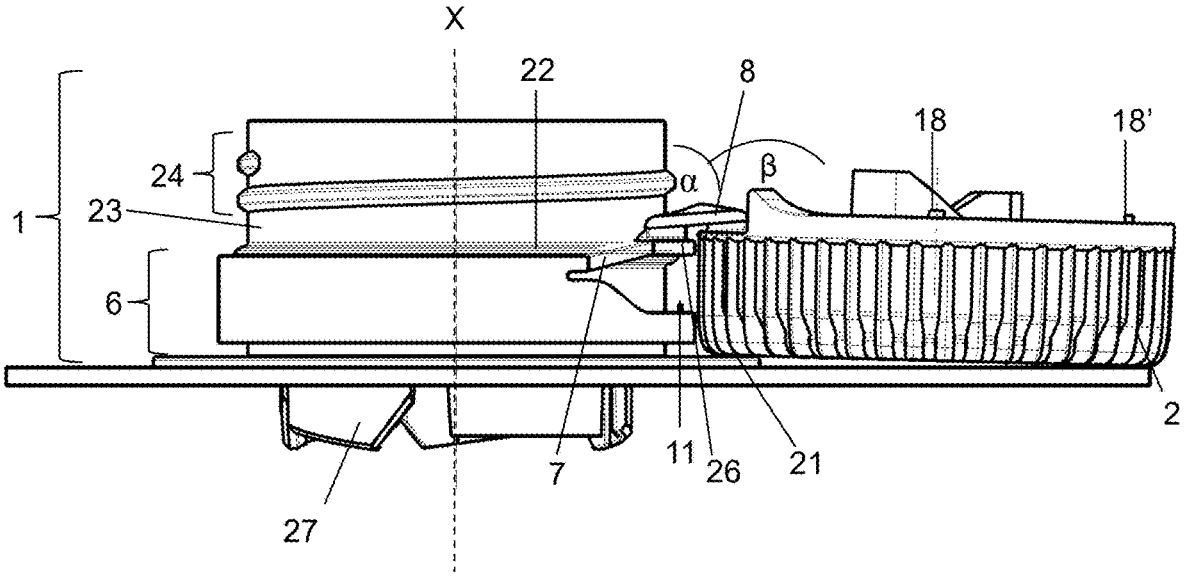
FIG. 7 depicts a perspective view of the second preferred embodiment of the screw closure according to the invention, wherein the screw cap is pivoted through an angle $\beta=180°$ and is in a secured end position.

FIG. 7 shows a perspective view of the second preferred embodiment of the screw closure 1 according to the invention, wherein the screw cap 2 is pivoted by an angle β=180° and is in a secured end position.

As can be seen in FIG. 7, when the screw cap 2 is unscrewed, it can be pivoted by an angle β=180° to the spout axis X and the pivoting plate 8 can be pivoted by an angle α=90° in the same direction of rotation.

Hereby, the screw cap 2 reaches a plane with its upper surface at least approximately parallel to the plane in which the circumferential flange 21 lies.

In the fully opened and pivoted state of the screw cap 2 shown here in FIG. 7, the pivoting plate 8 is in a stable end position in which the free edge of the pivoting plate 8 rests against the spout surface.

As can be seen further in FIG. 7, in the fully open and pivoted position of the screw cap 2, the pivoting plate 8 rests against a cam 26 arranged on the spout 23.

Furthermore, FIG. 7 shows a cutting element 27 formed on the spout 23, which is suitable for cardboard containers with aseptic contents and only opens the cardboard container when the screw cap is turned. Alternatively, in the second preferred embodiment shown here, such a cutting element 27 can be dispensed with if, for example, a fresh product is selected as the contents of the cardboard container.

Figure 8:
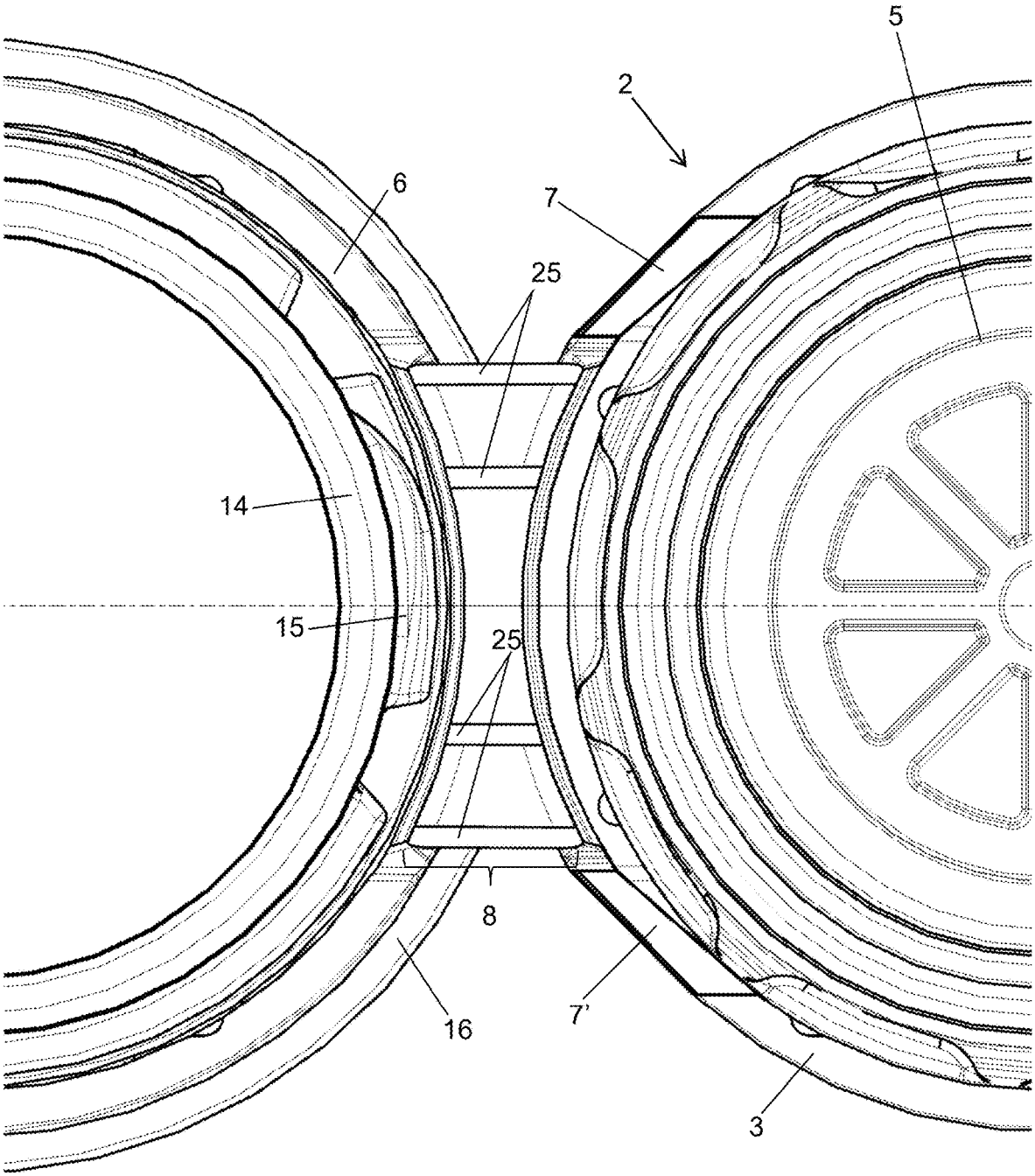
FIG. 8 depicts a top view of the first preferred embodiment of the screw closure according to the invention with the screw cap pivoted through an angle β=180°, the pivoting plate being designed as a 2-strap hinge.

FIG. 8 shows a top view of the first preferred embodiment of the screw closure according to the invention with the screw cap pivoted by an angle β=180°, wherein the pivoting plate is designed as a 2-strap hinge.

The pivoting plate 8 is designed here as a multiple-strap hinge, here in particular as a 2-strap hinge, which has two straps 25 on each side for mechanical reinforcement.

Figure 9:
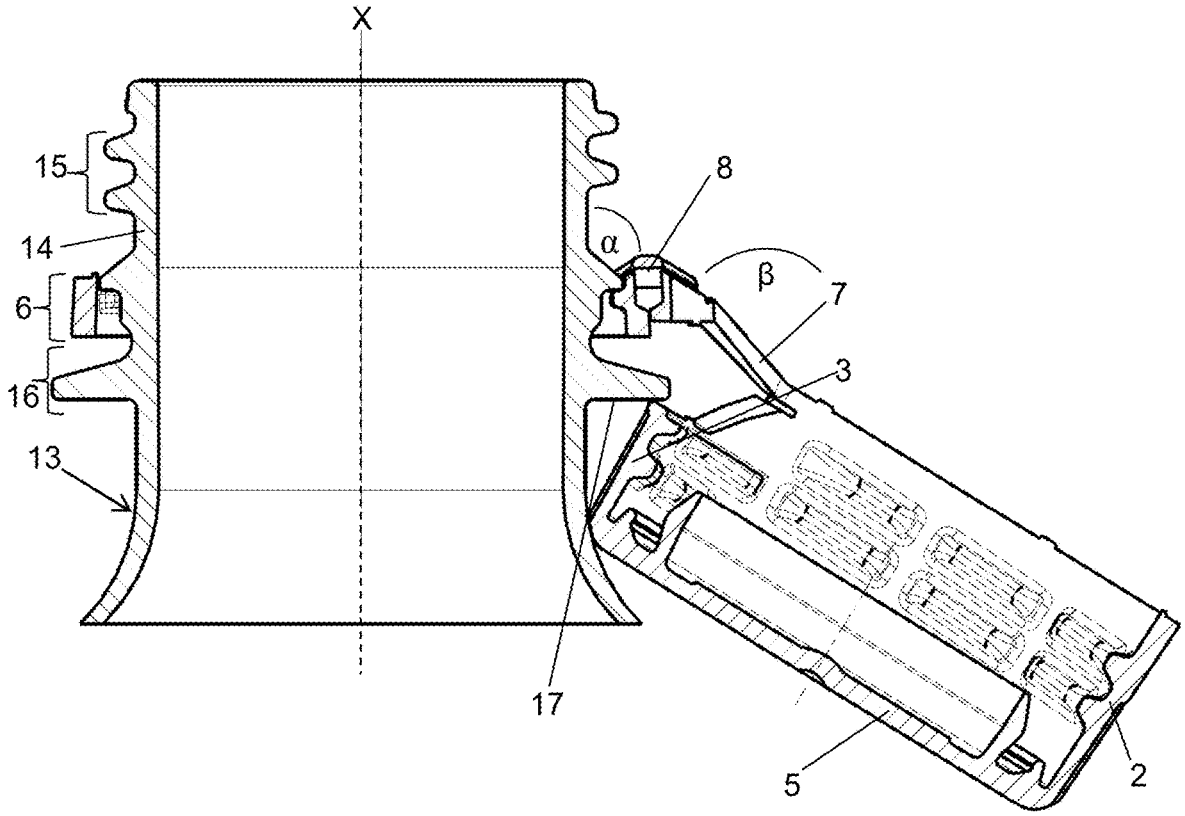
FIG. 9 depicts a sectional view of the first preferred embodiment with the screw cap pivoted, wherein the screw cap is pivoted through an angle β of more than 180° and the screw cap rests against the bottleneck.

FIG. 9 shows a sectional view of the first preferred embodiment with pivoted screw cap 2, whereby here the screw cap 2 is pivoted respectively can be pivoted by an angle β of more than 180° and the screw cap 2 rests against the bottleneck 14. Here, the lower edge of the screw cap 2 is in direct contact with the retaining shoulder 17 of the support ring 16.

The scope of protection of the present invention is given by the claims and is not limited by the features illustrated in the description or shown in the figures.

What is claimed is:

1. A screw closure comprising a tamper-evident band and a screw cap captively connected thereto, the screw cap comprising:

an outer surface comprising an internal thread, and an upper surface, and wherein the screw closure comprises:

at least one pulling element configured to enable axial longitudinal movement of the screw cap in a direction of a longitudinal axis of the screw closure to the tamper-evident band, and a pivoting element, wherein the pivoting element is either arranged:

connected with the tamper-evident band in a fixed and pivotable manner, and detachably connected to the screw cap, or wherein the pivoting element is arranged:

connected to the screw cap in a fixed and pivotable manner, and detachably connected to the tamper-evident band, wherein the pivoting element is configured to permit a deformation required for pivoting movement, wherein the pivoting element is a pivoting plate, and the pivoting plate is non-detachably connected to the tamper-evident band, wherein:

the screw closure is configured to be mounted on a plastic bottle comprising a bottleneck and an external thread, below which a circumferential support ring is arranged and an annular retaining shoulder extends below the circumferential support ring, in an unscrewed state the screw cap is configured to pivot through an angle β of at least 180° to a spout axis, and wherein, the pivoting plate is configured to pivot through an angle α=90° in a same direction of rotation and reach a secured end position.

2. The screw closure according to claim 1, wherein the detachable connection between the pivoting element and the screw cap is arranged via at least one first predetermined breaking point bridge, or wherein the detachable connection between the screw cap and the tamper-evident band is arranged via at least one second predetermined breaking point bridge.

3. The screw closure according to claim 1, wherein, in the secured end position, the pivoting plate lies essentially in a same plane as the support ring on the bottleneck.

4. The screw closure according to claim 1, wherein, in the secured end position, an edge section of the screw cap is arranged to be engaged under the retaining shoulder of the bottleneck.

5. The screw closure according to claim 1, wherein the at least one pulling element comprises two pulling elements arranged so as to, before the initial opening, run from the separation plane between the tamper-evident band and the lower edge of the screw cap inclined upwards to the separation line between the screw cap and the pivoting plate and merge into the pivoting plate upper edge.

6. A screw closure comprising a tamper-evident band and a screw cap captively connected thereto, the screw cap comprising:

an outer surface comprising an internal thread, and an upper surface, and wherein the screw closure comprises:

at least one pulling element configured to enable axial longitudinal movement of the screw cap in a direction of a longitudinal axis of the screw closure to the tamper-evident band, and a pivoting element, wherein the pivoting element is either arranged:

connected with the tamper-evident band in a fixed and pivotable manner, and detachably connected to the screw cap, or wherein the pivoting element is arranged:

connected to the screw cap in a fixed and pivotable manner, and detachably connected to the tamper-evident band, wherein the pivoting element is configured to permit a deformation required for pivoting movement, and wherein the pivoting element is a snap hinge.

7. The screw closure according to claim 1, wherein the pivoting element is a pivoting plate and the pivoting plate comprises an integrated pivoting hinge.

8. The screw closure according to claim 7, wherein the pivoting hinge comprises two arcuate and opposing film hinges connected over an entire width of the pivoting plate and arranged to approach each other centrally in a direction of extent and configured to function as a snap hinge.

9. A screw closure comprising a tamper-evident band and a screw cap captively connected thereto, the screw cap comprising:

an outer surface comprising an internal thread, and an upper surface, and wherein the screw closure comprises:

at least one pulling element configured to enable axial longitudinal movement of the screw cap in a direction of a longitudinal axis of the screw closure to the tamper-evident band, and a pivoting element, wherein the pivoting element is either arranged:

connected with the tamper-evident band in a fixed and pivotable manner, and detachably connected to the screw cap, or wherein the pivoting element is arranged:

connected to the screw cap in a fixed and pivotable manner, and detachably connected to the tamper-evident band, wherein the pivoting element is configured to permit a deformation required for pivoting movement, and wherein the pivoting element is a pivoting plate, and the pivoting plate is non-detachably connected to the screw cap, wherein:

the screw closure is configured to attach to a spout comprising a circumferential flange configured to attach to a container or a bag, the spout comprises at least one external thread configured to fasten the screw cap, a circumferential retaining bead arranged below the thread and configured to axially secure the position of the tamper-evident band on the spout, the pivoting plate is arranged connected in a closed state before the initial opening by at least one predetermined breaking point bridge, in an unscrewed state of the screw cap, the screw cap is configured to pivot by an angle $\beta=180°$ to the spout axis and the pivoting plate is configured to pivot by an angle $\alpha=90°$ in a same direction of rotation, so that the screw cap, with its upper surface, comes into a plane at least approximately parallel to a plane in which the circumferential flange lies.

10. The screw closure according to claim 7, wherein the at least one pulling element comprises two pulling elements arranged, before the initial opening, to run from the upper edge of the tamper-evident band on both sides of the pivoting plate inclined downwards to the separation plane between the pivoting plate and tamper-evident band and merge into the lower edge of the pivoting plate.

11. The screw closure according to claim 9, wherein, in a fully opened and pivoted state of the screw cap, the pivoting plate is configured to reach a stable end position wherein a free edge of the pivoting plate is arranged to rest against the spout surface.

12. The screw closure according to claim 9, wherein the pivoting element is a snap hinge.

13. The screw closure according to claim 9, wherein the pivoting plate comprises an integrated pivoting hinge.

14. The screw closure according to claim 12, wherein the pivoting hinge comprises two arcuate and opposing film hinges extending over an entire width of the pivoting plate, which film hinges approach each other centrally in the direction of extent and are configured to act as a snap hinge.

15. The screw closure according to claim 11, wherein, in the fully opened and pivoted position of the screw cap, the pivoting plate is arranged to rest against the spout in a threaded passage.

16. The screw closure according to claim 11, wherein the pivoting plate is arranged to rest against a cam arranged on the spout in the fully opened and pivoted position of the screw cap.

17. The screw closure according to claim 9, wherein the screw closure comprises a cutting element formed on the spout.

18. The screw closure according to claim 1, wherein the pivoting element embodied as a pivoting plate comprises multiple parts and is a multiple-strap hinge configured to function as a snap hinge.

19. The screw closure according to claim 18, wherein the multiple-strap hinge is a 2-strap hinge or a 3-strap hinge.

20. The screw closure according to claim 1, wherein the pivoting element is a pivoting plate.

* * * * *